US011604051B2

(12) United States Patent
Percy

(10) Patent No.: US 11,604,051 B2
(45) Date of Patent: Mar. 14, 2023

(54) ARROW NOISEMAKER

(71) Applicant: Tyler Percy, Springfield, MO (US)

(72) Inventor: Tyler Percy, Springfield, MO (US)

( * ) Notice: Subject to any disclaimer, the term of this patent is extended or adjusted under 35 U.S.C. 154(b) by 0 days.

(21) Appl. No.: 17/198,746

(22) Filed: Mar. 11, 2021

(65) Prior Publication Data

US 2021/0285746 A1 Sep. 16, 2021

Related U.S. Application Data

(60) Provisional application No. 62/988,964, filed on Mar. 13, 2020.

(51) Int. Cl.
*F42B 6/04* (2006.01)

(52) U.S. Cl.
CPC ..... *F42B 6/04* (2013.01)

(58) Field of Classification Search
CPC .... F42B 6/003; F42B 6/02; F42B 6/04; F42B 6/08
See application file for complete search history.

(56) References Cited

U.S. PATENT DOCUMENTS 1,328,967 A 1/1919 Birkley
2,443,395 A * 6/1948 Lutins ..... F42B 12/362 473/571
2,836,930 A * 6/1958 Ragazzo ..... F42B 6/04 446/213
2,838,871 A * 6/1958 Boring ..... A63H 5/00 473/585
3,418,995 A * 12/1968 Heller ..... A63H 27/005 473/582
4,203,252 A * 5/1980 Howie ..... A63H 5/00 446/216
4,489,949 A 12/1984 Taylor et al.
5,269,535 A 12/1993 Gagne
6,083,127 A * 7/2000 O'Shea ..... A63H 33/18 446/213
9,279,646 B1 * 3/2016 Crispell ..... F42B 6/04
9,482,505 B2 * 11/2016 Román ..... F42B 12/38
10,161,731 B2 * 12/2018 Lish ..... F42B 12/362
10,451,391 B2 * 10/2019 Mook ..... F42B 6/06

OTHER PUBLICATIONS https://www.amazon.com/IRQ-Broadheads-Compatible-Crossbow-Compound/dp/B07TVDKFWG last accessed on Mar. 10, 2021.

* cited by examiner

*Primary Examiner* — John A Ricci
(74) *Attorney, Agent, or Firm* — The Dobrusin Law Firm, P.C.

(57) ABSTRACT

An arrow noisemaker and arrow incorporating the same. The arrow noisemaker comprises a sleeve adapted to fit onto a shaft of an arrow, one or more housings coupled to the sleeve, and one or more noisemakers, each of which are coupled to each of the one or more housings. The one or more housings de-couple from the sleeve upon impact with a game animal.

18 Claims, 4 Drawing Sheets

ARROW NOISEMAKER

FIELD

The present teachings generally relate to an arrow noisemaker and arrow comprising the same. The arrow noisemaker may be advantageous in distracting game animals and preventing game animals from reacting to the sound of a bow.

BACKGROUND

Archery is a popular method of hunting game animals such as deer, elk, rabbits, and turkeys. Archery involves the use of arrows, as projectiles, launched from bows. Bows are conventionally provided in various forms such as recurve bows, compound bows, and crossbows. Common amongst all forms of bows is the use of a string to transfer potential energy, generated by hunters pulling back on the string, into kinetic energy when hunters release the string, causing an arrow's flight. One consequence of the string's transfer of energy to an arrow is the generation of noise. The noise can be a result of the string and/or arrow travelling through the air, vibration of the string caused by sliding of the same along the fingertips of a hunter, and sliding of the arrow along an arrow rest. Noise generated by a hunter can be heard by game animals and often results in the game animal physically reacting. In response to being startled by noise, game animals may turn, jump, hunch, or run. Due to the small target, even on larger game animals, in which a clean, ethical harvest is executed, even the slightest movement of the game animal can cause a missed shot. Not only is this disappointing for hunters, but game animals can be wounded and either run away and perish where a hunter will not be able to retrieve their harvest or live with the pain or even a handicap caused by a wound. An ethical harvest is a hunter's primary objective. Some hunters attempt to adjust their aim to compensate for the reaction movement of the game animal.

Not all noises cause reactions in game animals that are adverse to a hunter's objective. For instance, rustling of leaves or the cracking of a branch may cause game animals to pause or maybe raise their head in curiosity. Cars driving on nearby roads can have a similar effect. In order to mitigate the reaction of a game animal it has not been considered before to intentionally produce a secondary sound during an arrow's flight to prevent adverse reactions by game animals by piquing their curiosity. Rather, much effort has been afforded to designing broadhead arrow tips that minimize noise generated during flight, such as what is taught in U.S. Pat. Nos. 6,997,827, 8,801,552, and 9,933, 238, incorporated herein by reference for all purposes.

It may be beneficial to provide an archery accessory that prevents game animals from turning, jumping, hunching, or running. It may be beneficial to provide an archery accessory that ensures a clean, ethical harvest. It may be beneficial to provide an archery accessory that produces a sound, secondary to the sound of a bow, to cause an animal to react with curiosity rather than fear. It may be beneficial to provide an archery accessory that generally does not interfere with an arrow's penetration into a game animal. It may be beneficial to provide an archery accessory that generally does not interfere with mechanical blades of a broadhead.

SUMMARY

The present disclosure relates to an arrow noisemaker and an arrow comprising the same, which may address at least some of the needs identified above, the arrow noisemaker may comprise a sleeve adapted to fit onto a shaft of an arrow, one or more housings coupled to the sleeve, and one or more noisemakers. Each of the one or more noisemakers may be coupled to each of the one or more housings. The one or more housings may de-couple from the sleeve upon impact with a game animal.

The sleeve may include one or more housing engaging members. The one or more housings may each include a sleeve engaging member. The housing engaging member may removably couple to the sleeve engaging member. The one or more housing engaging members may include a slot and the sleeve engaging member may include a projection, or vice versa. The projection may friction-fit into the slot.

The one or more housings may be coupled to the sleeve via an adhesive. The adhesive may be disposed between the one or more housings and the sleeve in a form of one or more beads, lines, or both. The one or more housings and the sleeve may be integrally connected via one or more integral members. The one or more integral members may be adapted to break upon impact with the game animal. The one or more integral members may have a thickness of between about 0.01 mm and 1 mm. The one or more integral members may each include a seam. The seam may be a perforated, thinner, or weakened portion of the one or more integral members, or any combination thereof. The seam may be formed by scoring, perforation, compression, molding, or any combination thereof.

The one or more housings may include pairs housings. The pairs of housings may be located on opposing sides of the sleeve. A longitudinal axis of the one or more housings may be arranged at an angle to a longitudinal axis of the sleeve. The angle may be between about 0.5° and 5°.

The one or more noisemakers to produce a secondary noise during flight of the arrow. The secondary noise may be characterized by a sound-level of between about 70 dB and 120 dB. The sleeve may be friction fit onto the shaft of the arrow.

The sleeve may include a front end oriented generally co-directional with a tip of the arrow. The one or more housings may include a front end oriented generally co-directional with the front end of the sleeve. The front end of the one or more housings may be offset from the front end of the sleeve by a length of between about 0.5 cm and 4 cm.

The present disclosure relates to an arrow, which may address at least some of the needs identified above, the arrow may comprise an arrow noisemaker. The arrow noisemaker may comprise a sleeve adapted to fit onto a shaft of the arrow, one or more housings coupled to the sleeve, and one or more noisemakers. Each of the one or more noisemakers may be coupled to each of the one or more housings. The one or more housings may de-couple from the sleeve upon impact with a game animal.

The sleeve may include one or more housing engaging members. The one or more housings may each include a sleeve engaging member. The housing engaging member may removably couple to the sleeve engaging member. The one or more housing engaging members may include a slot and the sleeve engaging member may include a projection, or vice versa. The projection may friction-fit into the slot.

The one or more housings may be coupled to the sleeve via an adhesive. The adhesive may be disposed between the one or more housings and the sleeve in a form of one or more beads, lines, or both. The one or more housings and the sleeve may be integrally connected via one or more integral members. The one or more integral members may be adapted to break upon impact with the game animal. The one or more integral members may have a thickness of between about 0.01 mm and 1 mm. The one or more integral members may each include a seam. The seam may be a perforated, thinner, or weakened portion of the one or more integral members, or any combination thereof. The seam may be formed by scoring, perforation, compression, molding, or any combination thereof.

The one or more housings may include pairs of housings. The pairs of housings may be located on opposing sides of the sleeve. A longitudinal axis of the one or more housings may be arranged at an angle to a longitudinal axis of the sleeve. The angle may be between about 0.5° and 5°.

The one or more noisemakers may produce a secondary noise during flight of the arrow. The secondary noise may be characterized by a sound-level of between about 70 dB and 120 dB. The sleeve may be friction fit onto the shaft of the arrow.

The sleeve may include a front end oriented generally co-directional with a tip of the arrow, and the one or more housings may include a front end oriented generally co-directional with the front end of the sleeve. The front end of the one or more housings may be offset from the front end of the sleeve by a length of between about 0.5 cm and 4 cm.

DETAILED DESCRIPTION

Figure 1:
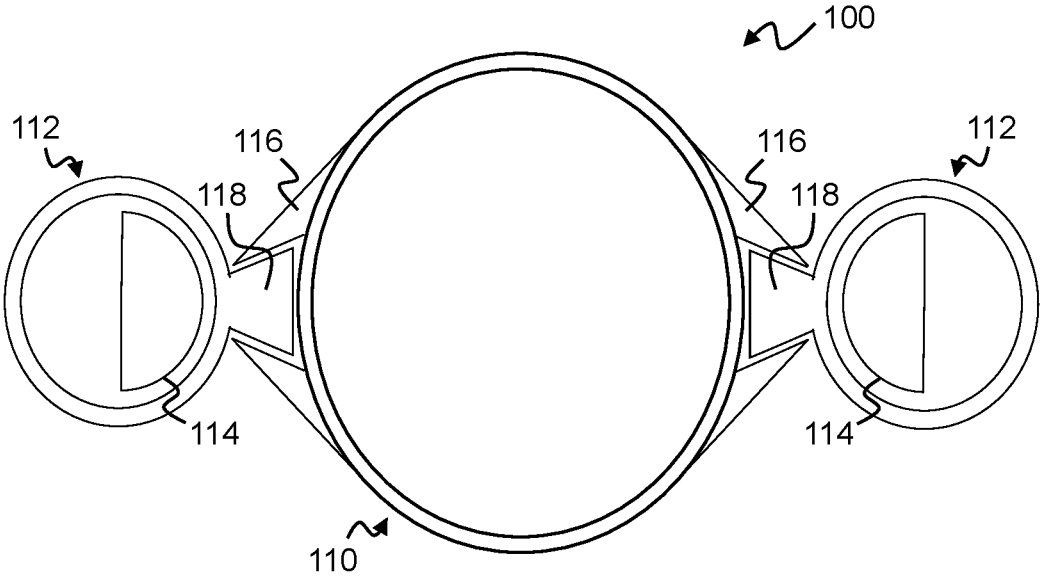
FIG. 1 is a plan view of a top of an arrow noisemaker.

The present teachings meet one or more of the above needs by the improved arrow noisemaker and arrow incorporating the same described herein. The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The arrow noisemaker of the present disclosure may be incorporated on one or more arrows. The arrow may be used for recreation, sport, hunting, or any combination thereof. The arrow may comprise a shaft, nock, tip, fletching, or any combination thereof. The shaft may be generally tubular, rod-like, or both. The shaft may be defined by a longitudinal axis extending along a length of the arrow and between two opposing ends of the arrow. The arrow may be provided in a length of about 70 cm or more, 75 cm or more, or even 80 cm or more. The arrow may be provided in a length of about 95 cm or less, 90 cm or less, or even 85 cm or less. The nock may be located on a rear end of the arrow. The nock may function to engage a bow string. The tip may be located on a front end of the shaft. The tip may include bullet arrow tips, field arrow tips, broadheads, the like, or any combination thereof. Broadheads may include blades that can be decoupled, fixed blades, mechanical blades, the like, or any combination thereof. Mechanical blades may fold. In a folded configuration, the blades may extend at least partially along a length of the shaft and/or over the sleeve of the arrow noisemaker. The tip may be removably or integrally coupled to the shaft. For example, typical hunting arrows include shafts and tips that are threaded so the tips may be screwed onto and off of the arrow. Some arrows may be provided with tips integrally coupled to the shaft, which may not be removed from the shaft. The fletching may be located on or adjacent to a rear end of the shaft. The fletching may function to stabilize the arrow during flight. The fletching may be coplanar with a longitudinal axis of the shaft, offset with respect to the longitudinal axis of the shaft, helically twisted around the shaft, or any combination thereof. The offset, helical twist, or both may cause the arrow to rotate during flight, thus stabilizing the arrow. The offset, helical twist, or both may be defined by an angle. The angle may be measured with respect to a longitudinal axis of the shaft. The angle may be about 0.5° or more, 1° or more, 1.5° or more, 2° or more, or even 2.5° or more. The angle may be about 5° or less, 4.5° or less, 4° or less, 3.5° or less, or even 3° or less. The fletching may extend radially a length from the shaft. The length may be about 1 cm or more, 1.5 cm or more, or even 2 cm or more. The length may be about 4 cm or less, 3.5 cm or less, or even 3 cm or less. The fletching may extend a length along the shaft. The length may be about 6 cm or more, 8 cm or more, or even 10 cm or more. The length may be about 16 cm or less, 14 cm or less, or even 12 cm or less. The fletching may include a feather, polymer vane, or both. The configuration of the fletching (e.g., angle, radial length, length along the shaft, and material) may vary widely from arrow to arrow. Fletching may be provided in a variety of configurations due to the personal preferences of hunters and the particular application the arrow may be used for. As discussed in greater detail hereunder, the arrow noisemaker of the present disclosure may be provided in and/or adjustable to various configurations that may complement the various configurations of the shaft, nock, fletching, tip, or any combination thereof.

The arrow may be shot from a bow. The bow may include recurve bows, compound bows, crossbows, the like, or any combination thereof. Although the construction of different types of bows may vary, bows may generally comprise one or more grips, shelves, arrow rests, limbs, strings, or any combination thereof. The arrow may interact with components of a bow and produce noise. The hunter's operation of the bow may produce noise. Noise may be produced by a string and/or arrow travelling through the air, vibration of the string caused by sliding of the same along the fingertips of a hunter, vibration of the string caused by limbs of the bow returning the string back to its unloaded position, sliding of the arrow along an arrow rest, deformation of limbs of the bow, frictional forces, the like, or any combination thereof. The noise may be characterized by a sound-level of between about 50 dB and 70 dB. Game animals may be startled by noise of this sound-level because ambient noise in remote wooded landscapes may be about 20 dB. While bows are generally quieter than firearms, the speed of sound may be generally greater than the speed at which the arrow travels. As a result, the noise generated by the bow, arrow, hunter, or any combination thereof may be heard by a game animal before the arrow reaches the game animal.

The present disclosure provides for an arrow noisemaker. The arrow noisemaker may function to produce a secondary noise, distract animals, pique the curiosity of game animals, or any combination thereof. The secondary noise may prevent animals from reacting to the noise produced by a bow, arrow, hunter, or any combination thereof. The game animals may perceive this noise to be a threat. Game animals may be familiar with the noise produced by a bow, arrow, hunter, or any combination thereof. For example, game animals may have been hunted before or in the vicinity of another hunted animal. The reaction of the animal, absent the secondary noise, may include turning, jumping, hunching, running, the like, or any combination thereof. The arrow noisemaker may produce a secondary noise to distract the game animal, pique the curiosity of the game animal, or any both. The secondary noise may cause the game animal to remain still. At most, the secondary noise may cause a game animal to raise its head. Raising of the head generally does not cause the kill zone of the game animal to move. As referred to herein, kill zone may mean the location of vital organs such as the heart, lungs, the like, or any combination thereof. The arrow noisemaker may continuously generate noise during an arrow's flight to keep the attention of the game animal until impact. The arrow noisemaker may allow a hunter to take a farther shot. Generally, the further a shot, the longer the game animal may have to react to noise generated by a bow, arrow, hunter, or any combination thereof. Game animals may react in 2/10 of a second and accordingly, hunters not employing the arrow noisemaker of the present disclosure generally should not take a shot beyond 23 meters. The arrow noisemaker may be located at any portion along a length of a shaft. It may be particularly advantageous to locate the arrow noisemaker on a shaft, adjacent to a broadhead in order for the arrow noisemaker to impact a game animal substantially immediately after the broadhead penetrates the game animal. It may be particularly advantageous to locate the arrow noisemaker on a shaft, adjacent to a broadhead to provide for easier application of the arrow noisemaker to the shaft. The arrow noisemaker may not interfere with the function of a broadhead. For example, folded mechanical blades may be free of obstruction by the arrow noisemaker. The arrow noisemaker may be removably coupled to an arrow. The arrow noisemaker may be disposable. The arrow noisemaker, or at least a portion thereof, may be integrally formed on and/or into an arrow, fletching, broadhead, nock, or any combination thereof. For example, an arrow may be provided with a sleeve integrally formed thereon. As another example, an arrow may include a noisemaker integrated into a shaft of the arrow with air inlets and outlets being formed on the circumference of the shaft and air channels extending through an interior of the shaft. The arrow noisemaker may comprise a sleeve coupled to an arrow, one or more housings coupled to the sleeve, one or more noisemakers coupled to the one or more housings, or any combination thereof. The sleeve may remain on the arrow during the flight path of an arrow, after the arrow impacts a game animal, or both. The sleeve may be located on a portion of an arrow that penetrates an animal. The housing may remain on the arrow during the flight path of an arrow, after the arrow impacts a game animal, or both. The housing may de-couple from the sleeve upon impact with a game animal. The housing may de-couple from the sleeve, so the housing does not diminish the penetration of the arrow. The arrow noisemaker may comprise one or more sleeves, housings, noisemakers, housing engaging members, sleeve engaging members, coupling members, or any combination thereof.

The arrow noisemaker may comprise one or more sleeves. The sleeve may function to couple to an arrow, retain one or more housings, retain one or more noisemakers, or any combination thereof. The sleeve may be removably or integrally coupled to an arrow. The sleeve may be coupled to a shaft of an arrow. The sleeve may be friction-fit, snap-fit, mechanically fastened, or chemically fastened to an arrow, or any combination thereof. Mechanically fasten may refer to the use of fasteners, interlocking overmolded members, or both. The fasteners may include bolts, screws, rivets, push pins, the like, or any combination thereof. The interlocking overmolded members may include a projection of the sleeve and a recess in an arrow, or vice versa. The interlocking overmolded members may be formed on a sleeve and/or arrow by extrusion, co-extrusion, injection molding, co-injection molding, overmolding, the like, or any combination thereof. For example, an arrow may be injection molded to include one or more projections and a sleeve may be overmolded onto the arrow and the one or more projections. Chemically fasten may refer to the use of an adhesive. The adhesive may include epoxy, polyurethane, polyimide, cyanoacrylate, phenol, methacrylate, the like, or any combination thereof. The sleeve may remain in place on an arrow upon impact with a game animal. The sleeve may slide down a length of an arrow or snap-off an arrow upon impact with a game animal, or both. The sleeve may be generally tubular. The sleeve may have a circular, ovoid, square, triangular, pentagonal, hexagonal, or other like cross-section. The sleeve may have a segmented cross-section. The segmented cross-section may be characterized by a base shape having a portion removed. The segmented cross-section may provide for a snap-fit of the sleeve onto an arrow. The sleeve may be defined by a length, width, inner diameter or cross-sectional length, outer diameter or cross-sectional length, thickness, or any combination thereof. The length may be about 1 cm or more, 3 cm or more, or even 5 cm or more. The length may be about 11 cm or less, 9 cm or less, or even 7 cm or less. The length may be less than, greater than, or generally equal to a length of one or more housings. The inner diameter or cross-sectional length may be generally equal to an outer diameter of an arrow. The inner diameter or cross-sectional length may be about 3 mm or more, 3.5 mm or more, 4 mm or more, 4.5 mm or more, or even 5 mm or more. The inner diameter or cross-sectional length may be about 8 mm or less, 7.5 mm or less, 7 mm or less, 6.5 mm or less, or even 6 mm or less. The outer diameter or cross-sectional length may be about 3 mm or more, 3.5 mm or more, 4 mm or more, 4.5 mm or more, or even 5 mm or more. The outer diameter or cross-sectional length may be about 8 mm or less, 7.5 mm or less, 7 mm or less, 6.5 mm or less, or even 6 mm or less. The thickness may be characterized by a difference between the inner diameter or cross-sectional length, and the outer diameter or cross-sectional length. The thickness may be about 0.01 mm or more, 0.1 mm or more, or even 0.25 mm or more. The thickness may be about 2 mm or less, 1 mm or less, or even 0.5 mm or less. The sleeve may be defined by a longitudinal axis extending along its length and between opposing ends of the sleeve. The sleeve may be provided with various inner diameters or cross-sectional lengths so arrows having various outer diameters may be accommodated. In this manner, the arrow noisemaker may be configured to be accepted by a variety of arrows. The sleeve may be fabricated from a deformable and/or elastic polymer. The deformable and/or elastic polymer may accommodate arrows having various outer perimeters. The sleeve may be fabricated from a deformable and/or elastic polymer. The sleeve may include a separate deformable and/or elastic polymer member disposed within the sleeve's inner perimeter. The deformable and/or elastic polymer member may extend perimetrically around an inner perimeter of the sleeve or at least a portion thereof. The deformable and/or elastic polymer may extend along a length of the sleeve or at least a portion thereof. In this manner, the arrow noisemaker may be provided as a one-size-fits-all product. The sleeve may be fabricated from polymer, metal, wood, or any combination thereof. The polymer may include silicone, polytetrafluoroethylene, polyoxymethylene, polyethylene, polypropylene, polyvinylchloride, polyamide, polycarbonate, polymethylmethacrylate, polyurethane, polyester, polyamide, polystyrene, the like, or any combination thereof. The metal may include aluminum, magnesium, zinc, tin, brass, iron, steel, titanium, the like, or any combination thereof. The sleeve may be formed by extrusion, co-extrusion, injection molding, co-injection molding, overmolding, thermoforming, stamping, drawing, cutting, the like, or any combination thereof. The sleeve may include one or more housing engaging members, coupling members, or both.

The arrow noisemaker may comprise one or more housings. The housing may function to house noisemakers, de-couple from a sleeve, or both. The housing may be removably coupled to a sleeve. The housing may be coupled to an outer perimeter of the sleeve. The housing may be friction-fit, snap-fit, mechanically fastened, or chemically fastened to a sleeve, or any combination thereof. Mechanically fasten may refer to the use of fasteners, interlocking overmolded members, or both. The fasteners may include bolts, screws, rivets, push pins, the like, or any combination thereof. The interlocking overmolded members may include a projection of the housing and a recess in a sleeve, or vice versa. The interlocking overmolded members may be formed on a housing and/or sleeve by extrusion, co-extrusion, injection molding, co-injection molding, overmolding, the like, or any combination thereof. For example, a sleeve may be injection molded to include one or more projections and a housing may be overmolded onto the arrow and the one or more projections. Chemically fasten may refer to the use of an adhesive. The adhesive may include epoxy, polyurethane, polyimide, cyanoacrylate, phenol, methacrylate, the like, or any combination thereof. The housing may be generally tubular. The housing may have a circular, ovoid, square, triangular, pentagonal, hexagonal, or other like cross-section. The housing may have a segmented cross-section. The segmented cross-section may be characterized by a base shape having a portion removed. The housing may be defined by a length, width, inner diameter or cross-sectional length, inner diameter or cross-sectional length, thickness, or any combination thereof. The length may be about 1 cm or more, 3 cm or more, or even 5 cm or more. The length may be about 11 cm or less, 9 cm or less, or even 7 cm or less. The length may be less than, greater than, or generally equal to a length of a sleeve. The inner diameter or cross-sectional length may be generally equal to an outer diameter or cross-sectional length of a noisemaker. The inner diameter or cross-sectional length may be about 3 mm or more, 3.5 mm or more, 4 mm or more, 4.5 mm or more, or even 5 mm or more. The inner diameter or cross-sectional length may be about 8 mm or less, 7.5 mm or less, 7 mm or less, 6.5 mm or less, or even 6 mm or less. The housing may be defined by a longitudinal axis extending along its length and between opposing ends of the housing. The longitudinal axis of the housing may be arranged at an angle to a longitudinal axis of the sleeve and/or arrow. The angle may be about 0.5° or more, 1° or more, 1.5° or more, 2° or more, 2.5° or more, 3° or more, 3.5° or more, or even 4° or more. The angle may be about 15° or less, 10° or less, 8° or less, 6° or less, or even 4° or less. The housings may include pairs of housings. Each pair of housings may be located on opposing sides of the sleeve. It may be particularly advantageous to provide the housings in pairs on opposing sides of the sleeve to retain the rotational balance of the arrow during flight and ensure a uniform parabolic flight path. The angle of opposing housings, viewed along a transverse axis of a sleeve, may be arranged in opposing directions. For example, viewed along a transverse axis of a sleeve, the angle of a first housing may be arranged at 1° and the angle of a second housing may be arranged at −1°. The angle may provide for rotation of an arrow during flight. The angle may complement the rotation of an arrow imparted by the arrow's fletching. The angle may be generally equal to an angle of fletching of an arrow. A front end of the housing may be offset from a front end of the sleeve by a length. As referred to herein, front end may mean the end oriented toward a tip of an arrow. The length may be about 0.5 cm or more, 1 cm or more, 1.5 cm or more, or even 2 cm or more. The length may be about 4 cm or less, 3.5 or less, 3 or less, or even 2.5 cm or less. The offset may prevent the housing from interfering with mechanical blades of a broadhead that may fold over onto at least a portion of the shaft, sleeve, or both. The housing may be fabricated from polymer, metal, wood, or any combination thereof. The polymer may include silicone, polytetrafluoroethylene, polyoxymethylene, polyethylene, polypropylene, polyvinylchloride, polyamide, polycarbonate, polymethylmethacrylate, polyurethane, polyester, polyamide, polystyrene, the like, or any combination thereof. The metal may include aluminum, magnesium, zinc, tin, brass, iron, steel, titanium, the like, or any combination thereof. The housing may be formed by extrusion, co-extrusion, injection molding, co-injection molding, overmolding, thermoforming, stamping, drawing, cutting, the like, or any combination thereof. The housing may include one or more noisemakers, sleeve engaging members, coupling members, or any combination thereof.

The arrow noisemaker may comprise one or more noisemakers. The noisemaker may function to produce a secondary noise, distract game animals, pique the curiosity of game animals, or any combination thereof. The noisemaker may include an elongate body that is at least partially hollow and/or troughed to receive air that flows therethrough. The noisemaker may include a reed disposed over and/or within the hollow and/or troughed portion. During travel of an arrow, air may flow over the reed and/or under the reed, causing vibration. The vibration may produce a secondary noise. An example of a suitable noisemaker may include the plastic squeaker reed, commercially available from Well Bond Toys. The vibration may produce a secondary noise. The secondary noise may be characterized by a sound-level of about 70 dB or more, 75 dB or more, 80 dB or more, 85 dB or more, or even 90 dB or more. The secondary noise may be characterized by a sound-level of about 120 dB or less, 115 dB or less, 110 dB or less, 105 dB or less, or even 100 dB or less. A longitudinal axis of the noisemaker may be colinear with a longitudinal axis of the sleeve and/or arrow. A longitudinal axis of the noisemaker may be arranged at an angle to a longitudinal axis of the sleeve and/or arrow. The angle may be about 0.5° or more, 1° or more, 1.5° or more, 2° or more, or even 2.5° or more. The angle may be about 5° or less, 4.5° or less, 4° or less, 3.5° or less, or even 3° or less. The noisemakers may include pairs of noisemakers, each coupled to a housing. Each pair of noisemakers may be located on opposing sides of the sleeve. The angle of opposing noisemakers, viewed along a transverse axis of a sleeve, may be arranged in opposing directions. For example, the angle of a first noisemaker may be arranged at 1° and the angle of a second noisemaker may be arranged at −1°. The angle may provide for rotation of an arrow during flight. The angle may complement the rotation of an arrow imparted by the arrow's fletching. The angle may be generally equal to an angle of fletching of an arrow. The noisemaker may be friction-fit, snap-fit, mechanically fastened, or chemically fastened to a housing, or any combination thereof. Mechanically fasten may refer to the use of fasteners, interlocking overmolded members, or both. The fasteners may include bolts, screws, rivets, push pins, the like, or any combination thereof. The interlocking overmolded members may include a projection of the noisemaker and a recess in a housing, or vice versa. Chemically fasten may refer to the use of an adhesive. The adhesive may include epoxy, polyurethane, polyimide, cyanoacrylate, phenol, methacrylate, the like, or any combination thereof.

The sleeve may comprise one or more housing engaging members. The housing engaging member may function to couple the sleeve to a housing. The housing engaging member may removably couple the sleeve to the housing. The housing engaging member may be located on a side of the sleeve. The housing engaging member may be co-linear with a longitudinal axis of the sleeve. The housing engaging member may extend along an entire length of the sleeve or at least a portion thereof. The housing engaging member may be slidably engaged to a sleeve engaging member. The housing engaging member may snap-fit or friction-fit with a sleeve engaging member, or both. The housing engaging member may be fabricated from polymer, metal, wood, or any combination thereof. The sleeve may comprise a housing engaging member for every housing. The polymer may include silicone, polytetrafluoroethylene, polyoxymethylene, polyethylene, polypropylene, polyvinylchloride, polyamide, polycarbonate, polymethylmethacrylate, polyurethane, polyester, polyamide, polystyrene, the like, or any combination thereof. The metal may include aluminum, magnesium, zinc, tin, brass, iron, steel, titanium, the like, or any combination thereof. The housing engaging member may be formed by extrusion, co-extrusion, injection molding, co-injection molding, overmolding, thermoforming, stamping, drawing, cutting, the like, or any combination thereof.

The housing may comprise one or more sleeve engaging members. The sleeve engaging member may function to couple the housing to a sleeve. The sleeve engaging member may removably couple the housing to the sleeve. The sleeve engaging member may be located on a side of the housing. The sleeve engaging member may be co-linear with a longitudinal axis of the housing. The sleeve engaging member may extend along an entire length of the housing or at least a portion thereof. The sleeve engaging member may be slidably engaged to a housing engaging member. The sleeve engaging member may snap-fit or friction-fit with a housing engaging member, or both. The sleeve engaging member may be fabricated from polymer, metal, wood, or any combination thereof. The polymer may include silicone, polytetrafluoroethylene, polyoxymethylene, polyethylene, polypropylene, polyvinylchloride, polyamide, polycarbonate, polymethylmethacrylate, polyurethane, polyester, polyamide, polystyrene, the like, or any combination thereof. The metal may include aluminum, magnesium, zinc, tin, brass, iron, steel, titanium, or any combination thereof. The sleeve engaging member may be formed by extrusion, co-extrusion, injection molding, co-injection molding, overmolding, thermoforming, stamping, drawing, cutting, the like, or any combination thereof.

In one aspect, the housing engaging member may include a slot and the sleeve engaging member may include a projection, or vice versa. The projection may be snap-fit or friction-fit into the slot, or both. The projection may slide within the slot. Upon impact with an animal, the projection may slide out of the slot resulting in the housing de-coupling from the sleeve. The projection and/or slot may include a triangular, square, rectangular, or trapezoidal cross-section. The cross-sectional shape of a housing engaging member may complement the cross-sectional shape of a sleeve engaging member.

Figure 2:
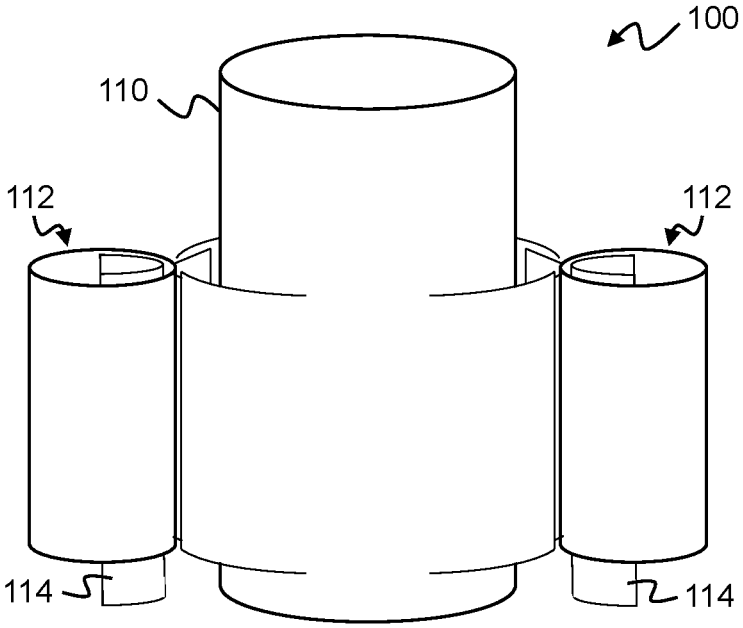
FIG. 2 is a perspective view of an arrow noisemaker.
Figure 3:
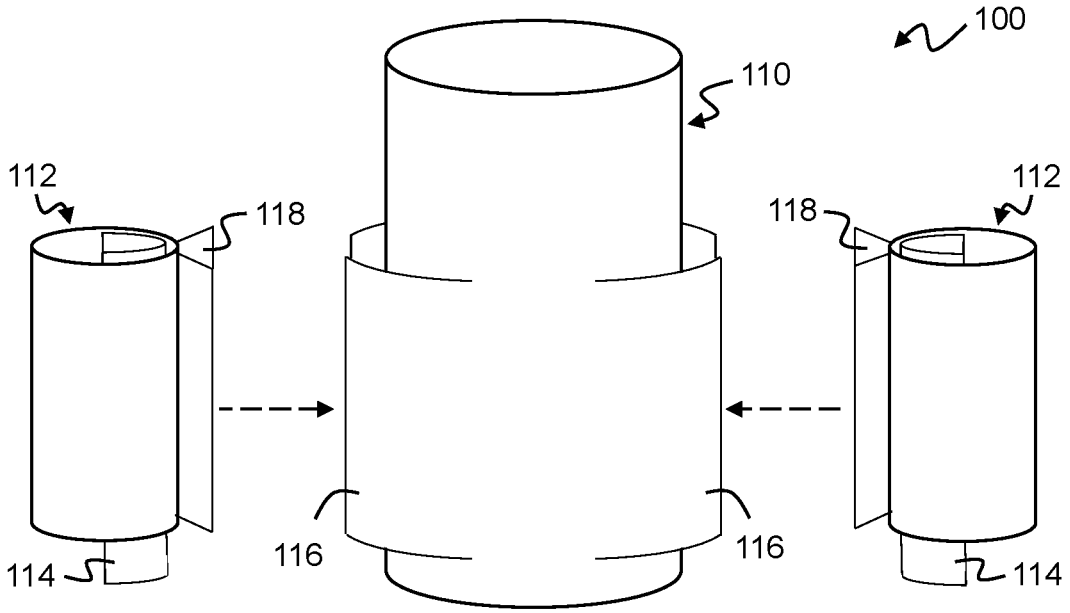
FIG. 3 is an exploded view of an arrow noisemaker.

The arrow noisemaker may comprise a coupling member. The coupling member may function to couple a housing and a sleeve together. The coupling member may include an adhesive, integral member, or both. The adhesive may include epoxies, polyurethanes, cyanoacrylates, or any combination thereof. The adhesive may be disposed on the housing and/or sleeve in beads, lines, films, or any combination thereof. The bond of the adhesive between the housing and the sleeve may break upon impact with a game animal. The integral member may include material integrally formed to both a sleeve and housing. The integral member may bridge between the sleeve and housing. For example, a sleeve and housing may be injection molded with the coupling member extending therebetween and coupling the sleeve and housing together. The integral member may extend between a housing and sleeve. The integral member may extend perimetrically around an outer perimeter of a housing, sleeve, or both. The integral member may be located anywhere along a length of the housing, sleeve, or both. The integral member may be sufficiently sized and shaped to break upon impact with a game animal. The integral member may be characterized by a thickness. The thickness may be about 0.01 mm or more, 0.1 mm or more, or even 0.2 mm or more. The thickness may be about 1 mm or less, 0.8 mm or less, or even 0.6 mm or less. The coupling member may be formed by extrusion, co-extrusion, injection molding, co-injection molding, overmolding, thermoforming, stamping, drawing, cutting, the like, or any combination thereof. The coupling member may include a seam. The seam may function to assist the de-coupling of a housing from a sleeve. The seam may be a perforated, thinner, or weakened portion of the coupling member, or any combination thereof. The seam may be formed by scoring, perforation, compression, molding, or any combination thereof FIGS. 1-3 illustrate an arrow noisemaker 100. FIG. 1 is a plan view of a top of an arrow noisemaker 100. FIG. 2 is a perspective view of an arrow noisemaker 100. FIG. 3 is an exploded view of an arrow noisemaker. The arrow noisemaker 100 comprises a center sleeve 110, two housings 112, two noisemakers 114, two housing engaging members 116, and two sleeve engagement members 118. The center sleeve 110 is generally tubular. The center sleeve 110 includes two housing engaging members 116 located on opposing sides of the sleeve 110. The two housing engaging members 116 couple to respective sleeve engaging members 118 of the two housings 112. The two housings 112 are located on opposing sides of the sleeve 110. The housings 112 are generally tubular. A noisemaker 114 is located within each housing 112.

Figure 4:
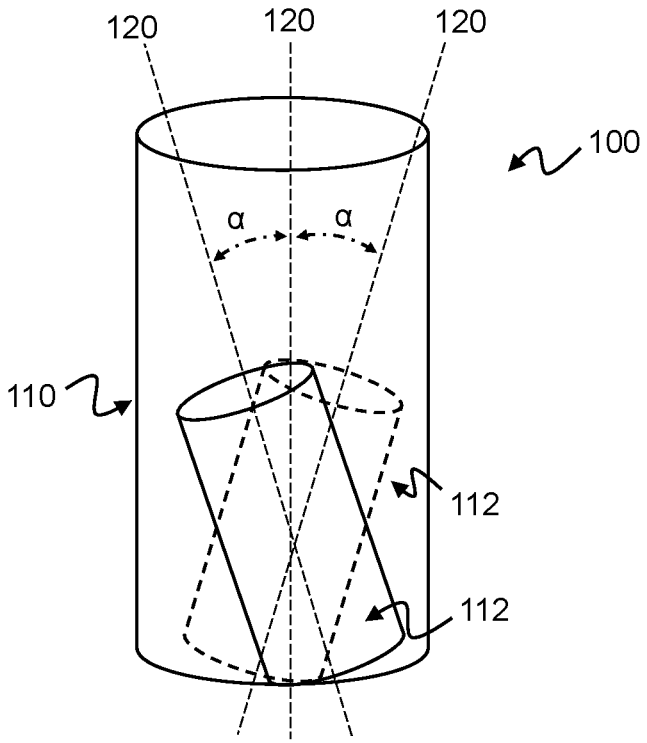
FIG. 4 is a perspective view of an arrow noisemaker.

FIG. 4 is a perspective view of an arrow noisemaker 100. The arrow noisemaker 100 comprises a center sleeve 110 and two housings 112. The two housings 112 are coupled to the center sleeve 110. A longitudinal axis 120 of each of the two housings 112 is oriented at an angle α with respect to a longitudinal axis 120 of the center sleeve 110. The angle α of one housing 112 is oriented in a positive direction with respect to the longitudinal axis 120 of the center sleeve 110. The angle α of the other housing 112 is oriented in a negative direction with respect to the longitudinal axis 120 of the center sleeve 110. A magnitude of the angle α of one housing 112 and a magnitude of the angle α of the other housing 112 are generally equal.

Figure 5:
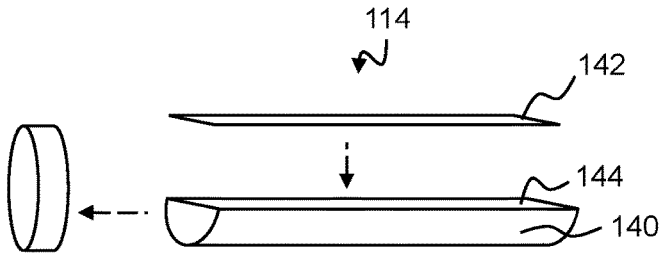
FIG. 5 is a perspective view of a noisemaker.
Figure 6:
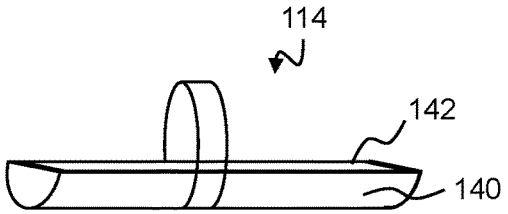
FIG. 6 is an exploded view of a noisemaker.

FIGS. 5 and 6 illustrate a noisemaker 114. FIG. 5 is a perspective view of a noisemaker 114. FIG. 6 is an exploded view of a noisemaker 114. The noisemaker 114 comprises a body 140 and reed 142. The body 140 includes a trough 144 formed therein. During flight of an arrow, air flows over the reed 142 and under the reed 142 through the trough 144. The air causes the reed 142 to vibrate, producing a secondary noise.

Figure 7:
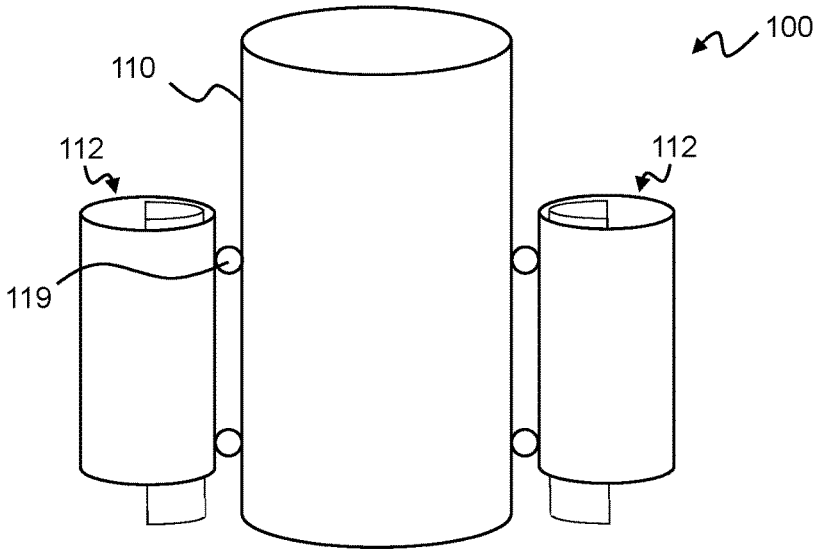
FIG. 7 is a perspective view of an arrow noisemaker.
Figure 8:
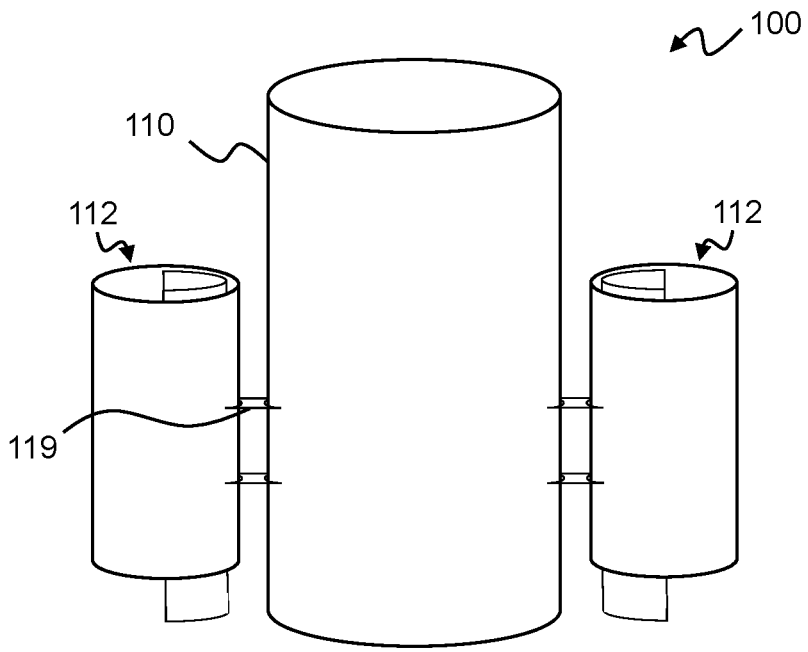
FIG. 8 is a perspective view of an arrow noisemaker.

FIGS. 7 and 8 are perspective views of an arrow noisemaker 100. The arrow noisemaker comprises a sleeve 110 and two housings 112. The sleeve 110 and two housings 112 are coupled together by four coupling members 119. The coupling members 119 extend between the housings 112 and the sleeve 110. The coupling members 119 are located along a length of the housings 112 and the sleeve 110. The coupling members 119 are located proximate to opposing ends of the housings 112. As shown in FIG. 7, the coupling members 119 are beads of adhesive. As shown in FIG. 8, the coupling members 119 are integral members.

Figure 9:
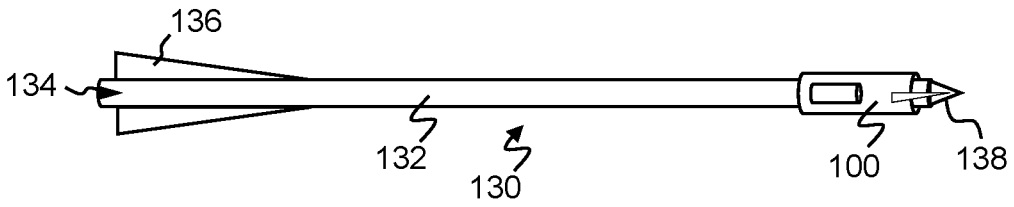
FIG. 9 is a perspective view of an arrow.

FIG. 9 is a perspective view of an arrow 130. The arrow 130 comprises a shaft 132, nock 134, fletching 136, broadhead 138, and arrow noisemaker 100. The arrow noisemaker 100 is located on the shaft 132 adjacent the broadhead 138. The broadhead 138 includes mechanical blades that are folded over a portion of the shaft 132 and a portion of the arrow noisemaker 100.

The explanations and illustrations presented herein are intended to acquaint others skilled in the art with the invention, its principles, and its practical application. The above description is intended to be illustrative and not restrictive. Those skilled in the art may adapt and apply the invention in its numerous forms, as may be best suited to the requirements of a particular use.

Accordingly, the specific embodiments of the present invention as set forth are not intended as being exhaustive or limiting of the teachings. The scope of the teachings should, therefore, be determined not with reference to this description, but should instead be determined with reference to the appended claims, along with the full scope of equivalents to which such claims are entitled. The omission in the following claims of any aspect of subject matter that is disclosed herein is not a disclaimer of such subject matter, nor should it be regarded that the inventors did not consider such subject matter to be part of the disclosed inventive subject matter.

Plural elements or steps can be provided by a single integrated element or step. Alternatively, a single element or step might be divided into separate plural elements or steps.

The disclosure of "a" or "one" to describe an element or step is not intended to foreclose additional elements or steps.

While the terms first, second, third, etc., may be used herein to describe various elements, components, regions, layers and/or sections, these elements, components, regions, layers and/or sections should not be limited by these terms. These terms may be used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The disclosures of all articles and references, including patent applications and publications, are incorporated by reference for all purposes. Other combinations are also possible as will be gleaned from the following claims, which are also hereby incorporated by reference into this written description.

REFERENCE NUMERALS

100 Arrow noisemaker
110 Sleeve
112 Housing
114 Noisemaker
116 Housing engaging member
118 Sleeve engaging member
119 Coupling member
120 Longitudinal axis
130 Arrow
132 Shaft
134 Nock
136 Fletching
138 Broadhead
140 Body
142 Reed
144 Trough

What is claimed is:

1. An arrow noisemaker comprising:
a sleeve adapted to fit onto a shaft of an arrow,
one or more housings coupled to the sleeve, and
one or more noisemakers, each of which are coupled to each of the one or more housings; and
wherein the one or more housings de-couple from the sleeve upon impact with a game animal;
wherein the one or more housings include a pair of housings; and
wherein the pair of housings are located on opposing sides of the sleeve.

2. The arrow noisemaker according to claim 1, wherein the sleeve includes one or more housing engaging members;
wherein the one or more housings each include a sleeve engaging member; and
wherein the one or more housing engaging members removably couple to the sleeve engaging member.

3. The arrow noisemaker according to claim 2, wherein the one or more housing engaging members include a slot and the sleeve engaging member includes a projection, or vice versa; and wherein the projection friction-fits into the slot.

4. The arrow noisemaker according to claim 1, wherein the one or more housings are coupled to the sleeve via an adhesive; and wherein the adhesive is disposed between the one or more housings and the sleeve in a form of one or more beads, lines, or both.

5. The arrow noisemaker according to claim 1, wherein the one or more housings and the sleeve are integrally connected via one or more integral members;

wherein the one or more integral members are adapted to break upon impact with the game animal; and wherein the one or more integral members have a thickness of between about 0.01 mm and 1 mm.

6. The arrow noisemaker according to claim 5, wherein the one or more integral members each include a seam;

wherein the seam is a perforated, thinner, or weakened portion of the one or more integral members, or any combination thereof; and wherein the seam is formed by scoring, perforation, compression, molding, or any combination thereof.

7. The arrow noisemaker according to claim 1, wherein a longitudinal axis of the one or more housings is arranged at an angle to a longitudinal axis of the sleeve;

wherein the angle is between about 0.5° and 5°.

8. The arrow noisemaker according to claim 1, wherein the one or more noisemakers produce a secondary noise during flight of the arrow; and wherein the secondary noise is characterized by a sound-level of between about 70 dB and 120 dB.

9. The arrow noisemaker according to claim 1, wherein the sleeve is friction fit onto the shaft of the arrow.

10. The arrow noisemaker according to claim 1, wherein the sleeve includes a front end oriented generally co-directional with a tip of the arrow, and the one or more housings include a front end oriented generally co-directional with the front end of the sleeve; and wherein the front end of the one or more housings is offset from the front end of the sleeve by a length of between about 0.5 cm and 4 cm.

11. An arrow comprising:

an arrow noisemaker comprising:

a sleeve adapted to fit onto a shaft of the arrow, one or more housings coupled to the sleeve, and one or more noisemakers, each of which are coupled to each of the one or more housings; and wherein the one or more housings de-couple from the sleeve upon impact with a game animal;

wherein the one or more housings include a pair of housings; and wherein the pair of housings are located on opposing sides of the sleeve.

12. The arrow according to claim 11, wherein the sleeve includes one or more housing engaging members;

wherein the one or more housings each include a sleeve engaging member;

wherein the one or more housing engaging members removably couple to the sleeve engaging member;

wherein the one or more housing engaging members include a slot and the sleeve engaging member includes a projection, or vice versa; and wherein the projection friction-fits into the slot.

13. The arrow according to claim 11, wherein the one or more housings are coupled to the sleeve via an adhesive; and wherein the adhesive is disposed between the one or more housings and the sleeve in a form of one or more beads, lines, or both.

14. The arrow according to claim 11, wherein the one or more housings and the sleeve are integrally connected via one or more integral members;

wherein the one or more integral members are adapted to break upon impact with the game animal;

wherein the one or more integral members have a thickness of between about 0.01 mm and 1 mm;

wherein the one or more integral members each include a seam;

wherein the seam is a perforated, thinner, or weakened portion of the one or more integral members, or any combination thereof; and wherein the seam is formed by scoring, perforation, compression, molding, or any combination thereof.

15. The arrow according to claim 11, wherein a longitudinal axis of the one or more housings is arranged at an angle to a longitudinal axis of the sleeve; and wherein the angle is between about 0.5° and 5°.

16. The arrow according to claim 11, wherein the one or more noisemakers produce a secondary noise during flight of the arrow; and wherein the secondary noise is characterized by a sound-level of between about 70 dB and 120 dB.

17. The arrow according to claim 11, wherein the sleeve is friction fit onto the shaft of the arrow.

18. The arrow according to claim 11, wherein the sleeve includes a front end oriented generally co-directional with a tip of the arrow, and the one or more housings include a front end oriented generally co-directional with the front end of the sleeve; and wherein the front end of the one or more housings is offset from the front end of the sleeve by a length of between about 0.5 cm and 4 cm.

* * * * *